US006866310B2

(12) United States Patent
Kobayashi et al.

(10) Patent No.: US 6,866,310 B2
(45) Date of Patent: Mar. 15, 2005

(54) DOOR LATCH OPERATION DEVICE FOR VEHICLE

(75) Inventors: Norikazu Kobayashi, Chita (JP); Koichi Hirota, Takahama (JP); Akio Sugiki, Kariya (JP); Koji Aoki, Nagoya (JP); Takaya Aiyama, Toyota (JP); Kazuyoshi Mori, Chiryu (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/107,309

(22) Filed: Mar. 28, 2002

(65) Prior Publication Data

US 2002/0140237 A1 Oct. 3, 2002

(30) Foreign Application Priority Data

Mar. 28, 2001 (JP) ..... 2001-094396
Mar. 28, 2001 (JP) ..... 2001-094397

(51) Int. Cl.[7] ..... E05C 3/06
(52) U.S. Cl. ..... 292/201; 292/216; 292/DIG. 23
(58) Field of Search ..... 292/201, 216, 292/169.14, DIG. 23, 198, DIG. 42, DIG. 43

(56) References Cited

U.S. PATENT DOCUMENTS 4,652,027 A * 3/1987 Quantz ..... 292/201
5,222,775 A * 6/1993 Kato ..... 292/201
5,615,564 A * 4/1997 Inoue ..... 70/279.1
5,642,636 A * 7/1997 Mitsui ..... 70/237
5,802,894 A 9/1998 Jahrsetz et al.
5,829,799 A * 11/1998 Yamagishi et al. ..... 292/201
5,992,194 A * 11/1999 Baukholt et al. ..... 70/279.1
6,059,327 A * 5/2000 Yoshikuwa ..... 292/216
6,286,878 B1 * 9/2001 Hochart et al. ..... 292/216
6,305,727 B1 * 10/2001 Bland ..... 292/216
6,338,508 B1 * 1/2002 Kleefeldt ..... 292/201
6,523,376 B2 * 2/2003 Baukholt et al. ..... 70/256
6,575,003 B1 * 6/2003 Dupont ..... 70/257
6,607,222 B2 * 8/2003 Inoue ..... 292/216

FOREIGN PATENT DOCUMENTS

| | | |
|---|---|---|
| DE | 196 00 524 A1 | 6/1997 |
| EP | 0 710 755 A1 | 5/1996 |
| EP | 0 959 205 A1 | 11/1999 |
| JP | 9-105262 A | 4/1997 |
| JP | 2000-54708 A | 2/2000 |
| JP | 2000-345752 A | 12/2000 |

* cited by examiner

*Primary Examiner*—J J Swann
*Assistant Examiner*—Thomas Ho
(74) *Attorney, Agent, or Firm*—Burns, Doane, Swecker & Mathis, L.L.P.

(57) ABSTRACT

A door latch operation device for vehicle which can link a mechanical operation member and a latch mechanism by an operation of a mechanical identification operation member. The door latch operation device includes a lift lever linked to the latch mechanism, an inside lever linked to the mechanical operation member, and an open link provided between the lift lever and the inside lever. The open link is adapted to be operatively connected to the mechanical operation member and the mechanical identification operation member to move the open link and cause the open link to engage the lift lever. The open link is also rotatable to be engaged with and disengaged from the inside lever. A guiding mechanism movably and rotatably guides the open link.

29 Claims, 11 Drawing Sheets

DOOR LATCH OPERATION DEVICE FOR VEHICLE

This application is based on and clam priority under 35 U.S.C. § 119 with respect to Japanese Application No. 2001-094396 filed on Mar. 28, 2001 and Japanese Application No. 2001-094397 filed on Mar. 28, 2001, the entire disclosure of both of which is incorporated herein by reference.

FIELD OF THE INVENTION

This invention generally relates to a door latch operation device for a vehicle door. More particularly, the present invention pertains to a door latch operation device for a vehicle door for operating a latch mechanism between a latched condition in which the vehicle door is maintained at a closed condition and an unlatched condition in which the vehicle door is adapted to be opened relative to the vehicle body.

BACKGROUND OF THE INVENTION

Known door latch operation devices for a vehicle are disclosed in Japanese Patent Laid-Open Publication No. 2000-54708 and Japanese Patent Laid-Open Publication No. 2000-345752. The door latch operation device described in Japanese Patent Laid-Open Publication No. 2000-54708 includes a latch mechanism, an electric actuation mechanism, a mechanical operation member, and a mechanical identification operation member. The latch mechanism is provided on the vehicle door, which is adapted to be opened and closed relative to the vehicle body, for performing a latched condition in which the vehicle door is maintained at the closed condition relative to the vehicle body and an unlatched condition in which the vehicle door is capable of being opened relative to the vehicle body. The electric actuation mechanism operates the latch mechanism from the latched condition to the unlatched condition. The mechanical operation member provided in the vehicle compartment actuates the latch mechanism from the latched condition to the unlatched condition. The mechanical identification operation member provided outside the vehicle compartment actuates the latch mechanism from the latched condition to the unlatched condition.

The door latch operation device described in Japanese Patent Laid-Open Publication No. 2000-345752 includes a latch mechanism, an electric actuation mechanism, and a mechanical operation member. The latch mechanism is provided on the vehicle door which is adapted to be opened and closed relative to the vehicle body for performing a latched condition in which the vehicle door is maintained at the closed condition relative to the vehicle body and for performing the unlatched condition in which the vehicle door is to be opened relative to the vehicle body. The electric actuation mechanism actuates the latch mechanism from the latched condition to the unlatched condition. The mechanical operation member is provided in the vehicle compartment and actuates the latch mechanism from the latched condition to the unlatched condition.

This known door latch operation device further includes an engagement-disengagement mechanism linked to the electric actuation mechanism between the mechanical operation member and the latch mechanism. Through actuation of the engagement-disengagement mechanism by driving the electric actuation mechanism, two conditions are performed, namely a non-set condition in which the mechanical operation member and the latch mechanism are linked and a set condition in which the linkage between the mechanical operation member and the latch mechanism is released. The anti-theft performance of the vehicle is improved by performing the set condition so that the latch mechanism is not actuated to the unlatched condition by unjustly operating the mechanical operation member.

However, providing the engagement-disengagement mechanism between the mechanical operation member and the latch mechanism as in the foregoing known device, a switching mechanism cannot be operated from the set condition to the non-set condition, although the latch mechanism can be operated from the latch condition to the unlatch condition by the operation of the mechanical identification operation member when the electric actuation mechanism fails during the set condition in which the linkage between the mechanical operation member and the latch mechanism is released. Thus, when an individual operates the mechanical identification operation member to open the vehicle door, enters the vehicle compartment and then closes the vehicle door, the vehicle door cannot be opened from inside the vehicle compartment because the linkage between the mechanical operation member and the latch mechanism is kept released by the engagement-disengagement mechanism.

A need thus exists for a door latch operation device for vehicle which can link the mechanical operation member and the latch mechanism by the operation of the mechanical identification operation member.

SUMMARY OF THE INVENTION

According to one aspect, a vehicle door latch operation device includes a latch mechanism provided on a vehicle door that is adapted to be opened and closed relative to a vehicle body for effecting a latched condition in which the vehicle door is maintained at a closed condition relative to the vehicle body and an unlatched condition in which the vehicle door is adapted to be opened relative to the vehicle body, a mechanical operation member provided in an interior compartment of the vehicle for operating the latch mechanism from the latched condition to the unlatched condition, and a mechanical identification operation member provided outside the vehicle for operating the latch mechanism from the latched condition to the unlatched condition. A lift lever is operatively connected to the latch mechanism, an inside lever is operatively connected to the mechanical operation member, and an open link is provided between the lift lever and the inside lever, with the open link being adapted to be operatively connected to the mechanical operation member and the mechanical identification operation member to move the open link and cause the open link to engage the lift lever, and with the open link also being rotatable to permit selective engagement of the open link with the inside lever. In addition, a guiding mechanism movably and rotatably guides the open link.

According to another aspect, a vehicle door latch operation device includes a latch mechanism provided on a vehicle door that is adapted to be opened and closed relative to a vehicle body for effecting a latched condition in which the vehicle door is maintained at a closed condition relative to the vehicle body and an unlatched condition in which the vehicle door is adapted to be opened relative to the vehicle body, an electric actuation mechanism which operates the latch mechanism from the latched condition to the unlatched condition, a mechanical operation member provided in an interior compartment of the vehicle for operating the latch mechanism from the latched condition to the unlatched condition, a mechanical identification operation member provided outside the vehicle for operating the latch mechanism from the latched condition to the unlatched condition, a lift lever operatively connected to the latch mechanism, and a lever mechanism. The lever mechanism includes an inside lever operatively connected to the mechanical operation member, an open link provided between the lift lever and the inside lever, an open lever linked to the electric actuation mechanism and engageable with the lift lever, and a key lever operatively connected to the mechanical identification operation member and engageable with the open link. The open link is adapted to be operatively connected to the mechanical operation member and the mechanical identification operation member to move the open link and cause the open link to engage the lift lever, with the open link also being rotatable to permit selective engagement of the open link with the inside lever. The open link is movably and rotatably supported on a base member, and a guiding mechanism movably and rotatably guides the open link.

According to another aspect, a vehicle door latch operation device includes a latch mechanism provided on a vehicle door that is adapted to be opened and closed relative to a vehicle body for effecting a latched condition in which the vehicle door is maintained at a closed condition relative to the vehicle body and an unlatched condition in which the vehicle door is adapted to be opened relative to the vehicle body, an interior door handle provided in an interior of the vehicle, a lift lever operatively connected to the latch mechanism, an inside lever operatively connected to the inside door handle, a key cylinder provided on an outside of the vehicle, a key lever operatively connected to the key cylinder, and an open link between the open lever and the lift lever, with the open link being supported in a housing for unlatching movement to engage the lift lever and effect the unlatched condition of the latch mechanism and being supported in the housing for rotatable movement. The inner lever and the key lever are operatively engageable with the open link. A guiding pin is provided on one of the open link and the housing and a guiding slot provided on the other of the open link and the guiding slot. The guiding pin is positioned in the guiding slot and the guiding slot is configured to guide the open link in the unlatching movement and the rotatable movement. The open link is rotatable between a first position in which operation of the interior door handle and the key lever causes the unlatching movement of the open link to effect the unlatched condition of the latch mechanism and a second position in which the unlatching movement of the open link is prevented when the interior door handle is operated.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
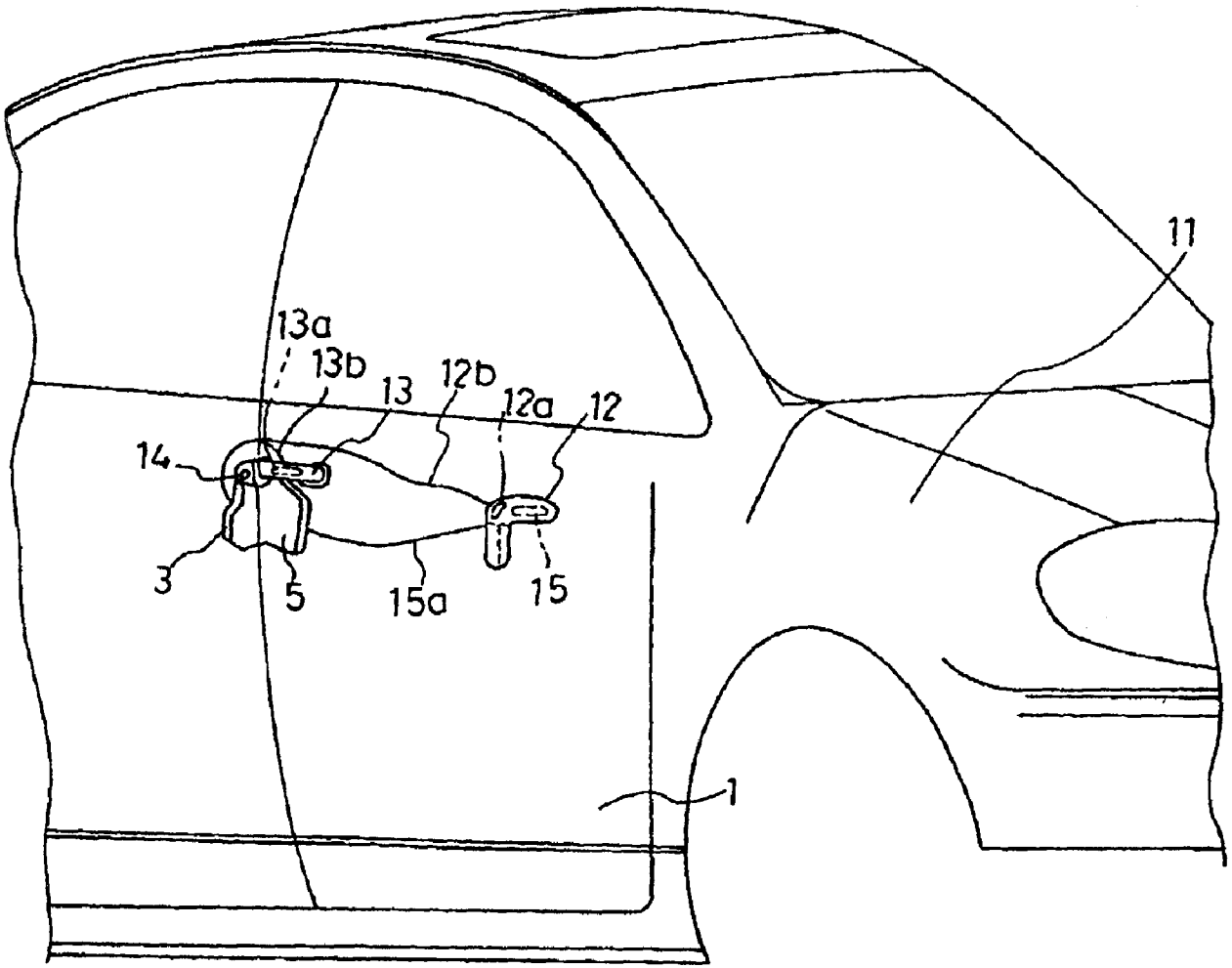
FIG. 1 is a perspective view of a vehicle in which is installed a door latch operation device according to one embodiment.

Referring to FIG. 1, a vehicle door 1 is supported by a vehicle body 11 and is adapted to be opened and closed relative to the vehicle body. The vehicle door is provided with a latch mechanism 3 which is engaged with and disengaged from a striker 2 (shown in FIG. 5) disposed on the vehicle body 11 for maintaining the vehicle door 1 at a closed condition.

Figure 5:
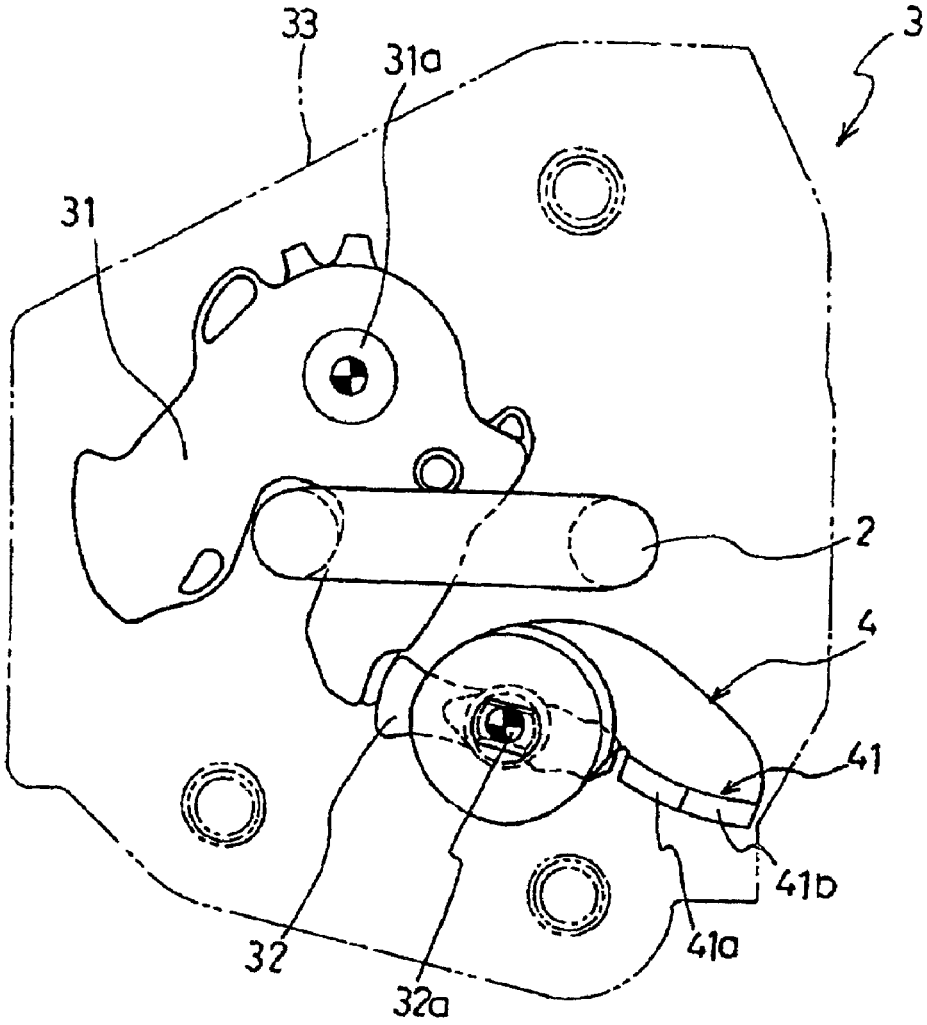
FIG. 5 is a front view of a latch mechanism for the door latch operation device.

As shown in FIG. 5, the latch mechanism 3 includes a latch 31, adapted to be engaged with and disengaged from the striker 2, and a pawl 32 adapted to be engaged with and disengaged from the latch 31. The latch 31 and the pawl 32 are accommodated in a resin-made body 33 and rotatably supported via respective support pins 31*a*, 32*a*. The pawl 32 restricts the rotation of the latch 31 by engaging the latch 31. The latch mechanism 3 is operable to produce a latched condition (shown in FIG. 5), in which the vehicle door 1 is maintained at the closed condition relative to the vehicle body 11, when the latch 31 is engaged with the pawl 32 while the latch 31 is engaged with the striker 2. The latch mechanism 3 is also operable to produce an unlatched condition, in which the vehicle door 1 is capable of being opened relative to the vehicle body 11, by rotating the pawl 32 in the counterclockwise direction of FIG. 5 to disengage the pawl 32 from the latch 31. Under the unlatched condition of the latch mechanism 3, the striker 2 can be disengaged from the latch 31. Thus, the vehicle door 1 can be opened by an individual through opening operation of the vehicle door 1 by operating assisting grips 12, 13 (shown in FIG. 1) provided in the vehicle compartment and on the outer surface of the vehicle door. The assisting grip 12 provided in the vehicle compartment can be grabbed by an individual when closing the door and the assisting grip 13 provided on the outside of the vehicle can be grabbed by an individual when opening the door.

The support pin 32*a* of the pawl 32 is secured to the pawl 32 for unitary rotation. The support pin 32*a* penetrates into the body 33 and the tip end of the support pin 32*a* extends outward. A lift lever 4 is adapted to unitarily rotate with the pawl 32 via the support pin 32*a* and has one end secured to the tip end of the support pin 32*a*. The other end of the lift lever 4 is provided with a flange wall 41 formed on a surface at approximately a right angle to the rotational direction. The flange wall 41 includes a first engagement portion 41*a* and a second engagement portion 41*b*. The first engagement portion 41*a* is positioned between the second engagement portion 41*b* and the support pin 32*a* which is the rotational center of the lift lever 4. Thus, the first engagement portion 41*a* of the flange wall 41 is positioned closer to the support pin 32*s* as compared to the second engagement portion 41*b* of the flange wall 41.

Figure 2:
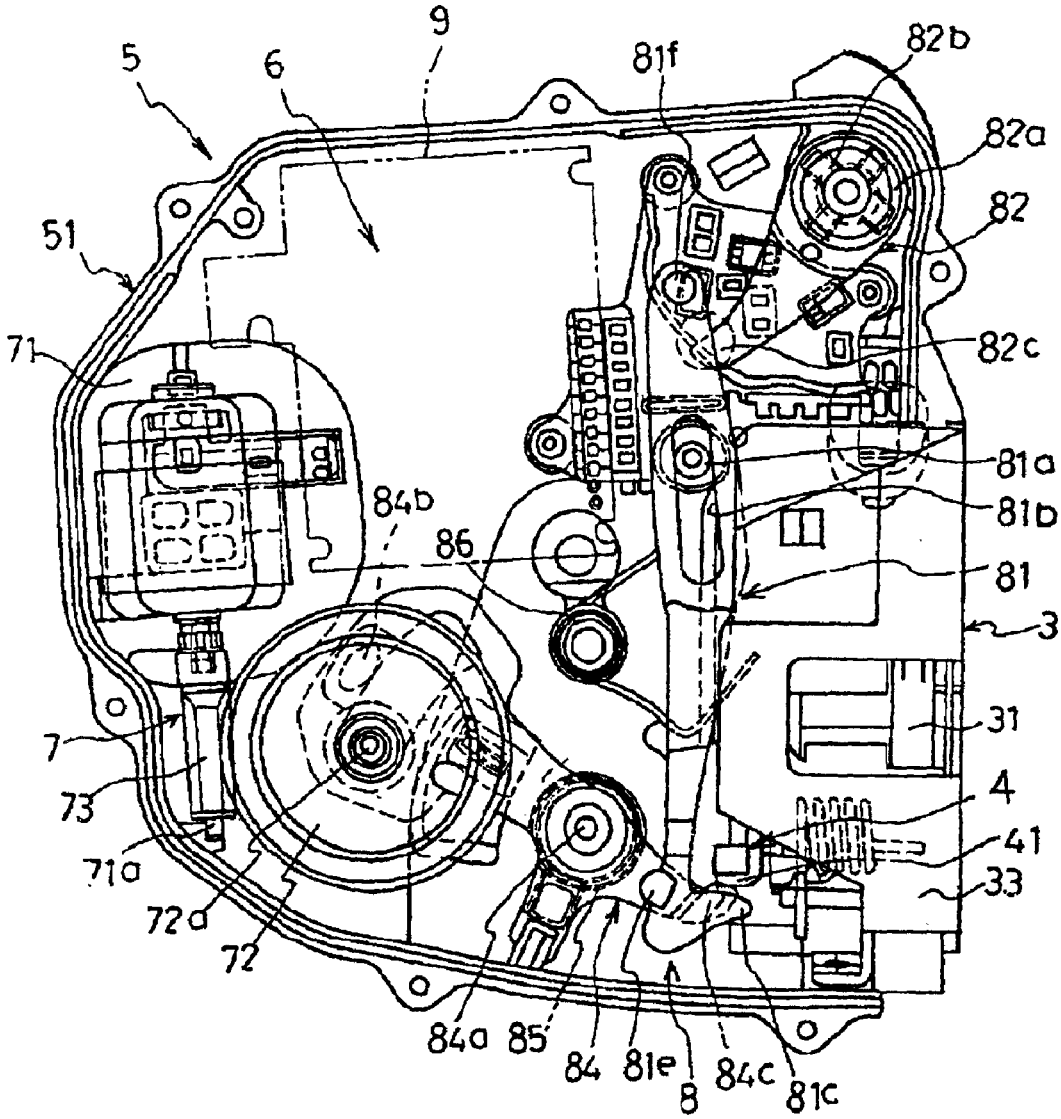
FIG. 2 is a front view of a release actuator for the door latch operation device.
Figure 3:
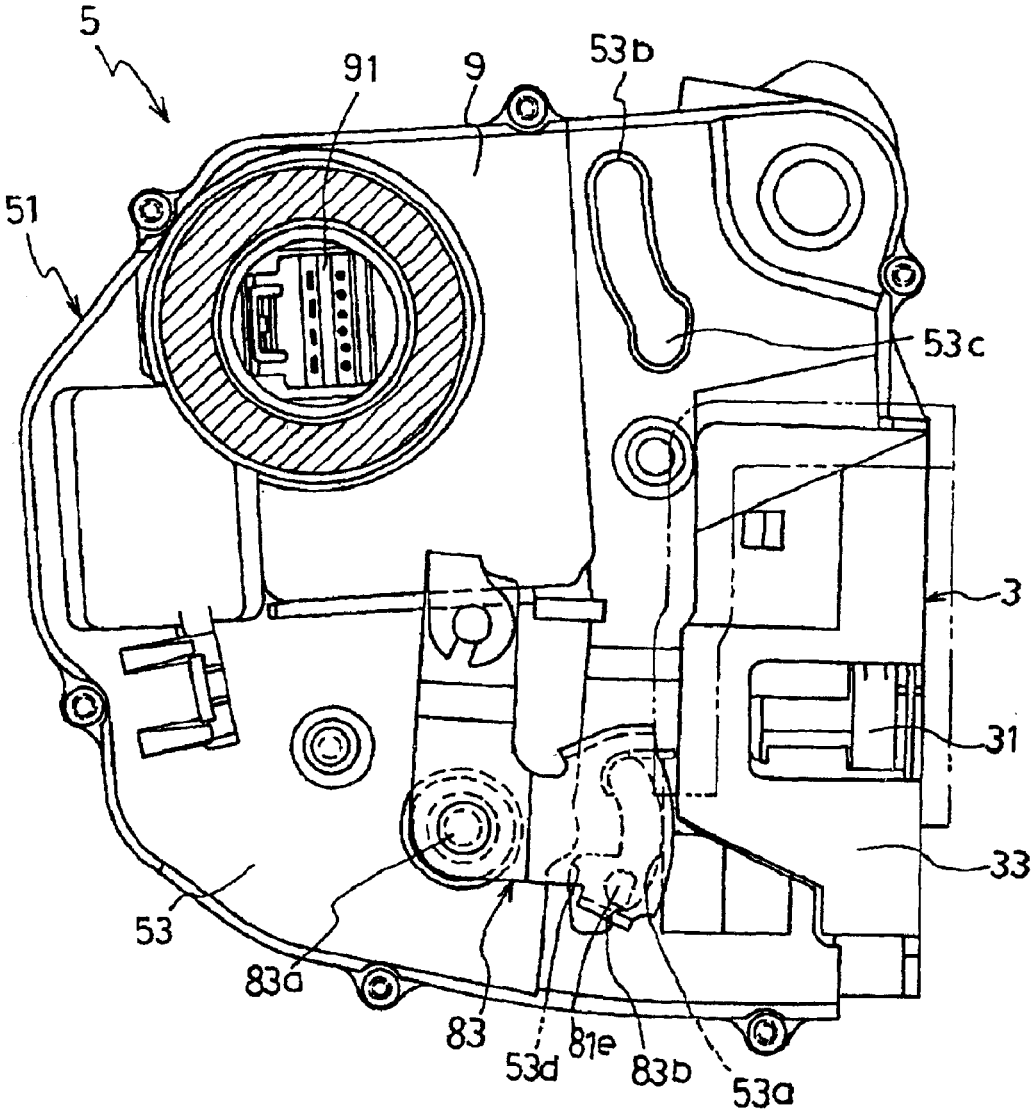
FIG. 3 is a rear view of the release actuator for the door latch operation device.
Figure 4:
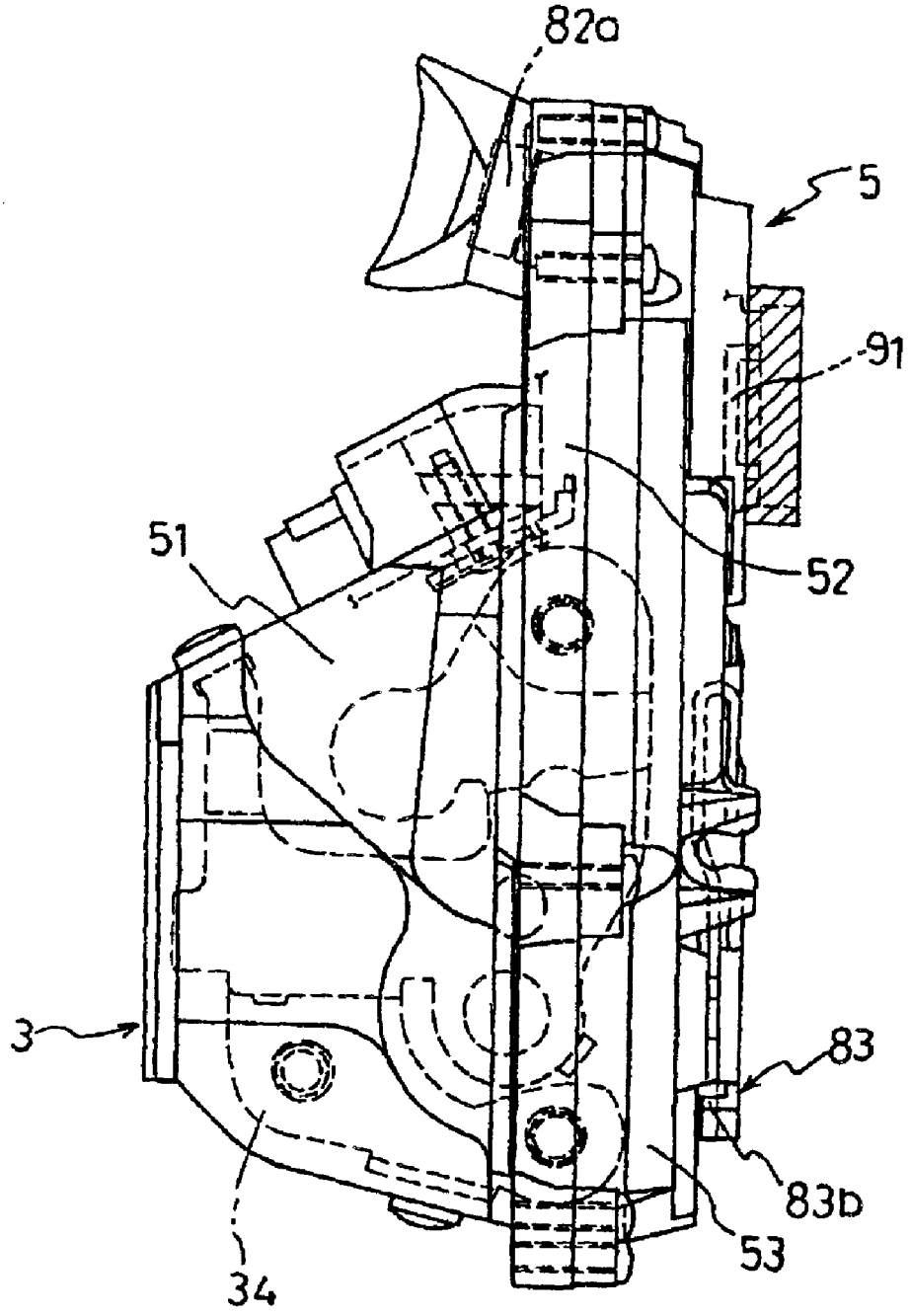
FIG. 4 is a side view of the release actuator for the door latch operation device.

Referring to FIGS. 2–4, the latch mechanism 3 is disposed in a housing 5 which can be made of resin. The housing 5 is L-shaped and includes a plate shaped support portion 51 and an accommodation portion 52 cooperating with a cover portion 53 of the housing and providing an accommodating space. The accommodating portion 52 is positioned substantially at a right angle relative to the support portion 51. The body 33 of the latch mechanism 3 is screwed on the support portion 51 via a base plate 34 that is fixed to the body 33. Thus, the latch mechanism 3 is supported by the housing 5 so that the lift lever 4 is covered with the supporting portion 51. Instead of a screw connection, the support portion 51 may support the body 33 by the engagement between an engagement detent and an engagement bore provided thereon respectively.

A release actuator 6 is accommodated in the accommodation portion 52. The release actuator 6 includes an electric actuation mechanism 7 and a lever mechanism 8. The electric actuation mechanism 7 includes an electric motor 71 serving as a power source and a wheel gear 72. The lever mechanism 8 includes an open link 81, a key lever 82, an inside lever 83, and an open lever 84.

The wheel gear 72 is rotatably supported in the housing 5 via a pin 72*a*. A worm gear 73 geared with the wheel gear 72 is secured to an output shaft 71*a* of the electric motor 71 so that the worm gear 73 and the output shaft 71*a* unitarily rotate together. Thus, the wheel gear 72 is decelerated and rotated by the actuation of the electric motor 71.

An engagement projection portion 72*b* (shown in FIG. 6) is formed on the wheel gear 72. The power is supplied to the electric motor 71 from a connector 91 connected to a controller 9, including a CPU, disposed in the housing 5. The electric motor is actuated by the operation of opening switches 12*a*, 13*a* electrically connected to the CPU of the controller 9 via respective harnesses 12*b*, 13*b*. The opening switches 12*b*, 13*b* are provided on the assist grips 12,13 shown in FIG. 1.

The CPU of the controller 9 determines a lock condition of the vehicle door 1 for prohibiting actuation of the electric motor 71 when the opening switches 12*a*, 13*a* are operated and determines an unlock condition of the vehicle door allowing actuation of the electric motor 71 when the opening switches 12*a*, 13*a* are operated. The setting of the lock condition and the unlock condition of the vehicle door 1 can be performed in a variety of ways such as by operating a lock switch provided at the vehicle door 1, by operating a remote control lock switch provided on an ignition key of the vehicle carried by an individual, and by identifying a code between the ignition key carried by the individual and the vehicle.

The open lever 84 is rotatably supported in the housing 5 via a pin 84*a*. An engagement projection 84*b* is formed on one end of the open lever 84. The engagement projection 84*b* is positioned opposite to the engagement projection portion 72*b* of the wheel gear 72. An engagement portion 84*c* is provided on the other end of the open lever 84. The engagement portion 84*c* is positioned opposite to the first engagement portion 41*a* of the lift lever 4.

With the construction as described above, the engagement projection 84*b* is engageable with the engagement projection portion 72*b* of the wheel gear 72. Thus, the open lever 84 is linked to the wheel gear 72. The open lever 84 is rotated in the counterclockwise direction of FIG. 2 by the rotation of the wheel gear 72 in the counterclockwise direction of FIG. 2 through engagement of the engagement projection portion 72*b* of the wheel gear 72 with the engagement projection 84*b*.

The engagement portion 84*c* is engageable with the first engagement portion 41*a*. Thus, the open lever 84 is linked to the lift lever 4. Through engagement between the engagement portion 84*c* and the first engagement portion 41*a* by clockwise rotation of the open lever 84 in FIG. 2, the lift lever 4 is rotated in the counterclockwise direction of FIG. 5 for disengaging the pawl 32 from the latch 31.

A spring 85 is supported on the pin 84*a* and is provided between the housing 5 and the open lever 84. The open lever 84 compresses the spring 85 by rotating in the counterclockwise direction of FIG. 2. The open lever 84 is returned to the initial position (shown in FIG. 2) by the biasing force of the spring 85.

The key lever 82 is rotatably supported in the housing 5 via a boss portion 82*a* formed on one end of the key lever 82. An end surface of the boss portion 82*a* penetrates through the cover 53 and is exposed to the outside of the housing 5. A cross-shaped connection groove 82*b* is formed on the end surface of the boss portion 82*a* of the key lever 82 and is connected via a connection rod to a key cylinder 14 (shown in FIG. 1) provided along with the assist grip 13 on the outside surface of the vehicle door 1. The key cylinder 14 serves as a mechanical identification operation member. The key lever 82 is rotated in the clockwise direction of FIG. 2 by operating the key cylinder 14 with an ignition key of the vehicle carried by an individual. The end of the key lever 82 opposite the boss portion 82*a* includes an engagement arm portion 82*c*.

The inside lever 83 is positioned outside of the housing 5 and is rotatably supported on the cover 53 via a pin 83*a*. The inside lever 83 is also connected via a cable 15*a* to an inside handle 15 provided along with the assist grip 12 on the interior of the vehicle door 1. The inside handle 15 constitutes a mechanical operation member. The inside lever 83 is rotated in the counterclockwise direction of FIG. 3 by the operation of the inside handle 15 by an individual. A flange wall 83*b* is also formed on the inside lever 83.

The open link 81 is movably supported in the housing 5, serving as a support member here, via a pin 81*a* and a longitudinal bore or slot 81*b*. The open link 81 is generally elongated, with the longitudinal direction of the open link 81 corresponding to the upward-downward direction of the vehicle (i.e., the up-down direction of FIG. 2). The longitudinal bore or slot 81*b* extends in the longitudinal direction of the open link 81 and is formed in the open link 81. The pin 81*a* is provided on the housing 5 and is inserted into the longitudinal bore 81*b*. The open link 81 moves in the longitudinal direction, with the pin 81*a* sliding along the longitudinal bore 81*b* and the open link 81 rotating about the pin 81*a*. A second engagement portion 81*c* is formed on the bottom end of the open link 81 and is positioned opposite to the second engagement portion 41*b* of the lift lever 4. An engagement pin portion 81*d* (shown in FIG. 6) is formed on the upper end of the open link 81 and is positioned opposite to the engagement arm portion 82*c* of the key lever 82. The bottom end of the open link 81 also includes an engagement pin portion 81*e* penetrating through the cover 53 and extending outside the housing 5. The engagement pin portion 81*e* is positioned opposite to the flange wall 83*b* of the inside lever 83.

The cover portion 53 includes an arc-shaped longitudinal guide slot (groove) portion 53*a* in which is positioned the engagement pin portion 81*e*. The engagement pin portion 81*e* moves along the arc-shaped longitudinal guide slot portion 53*a* so that the engagement pin portion 81*e* moves along a path generally centered at the pin or boss portion 83*a* of the inside lever 83. That is, the center of curvature of the arc-shaped longitudinal guide slot portion 53*a* generally coincides with the pin or boss portion 83*a* of the inside lever 83.

The cover portion 53 also includes an arc-shaped longitudinal guide slot (groove) portion 53*b* in which is positioned a guide pin 81*f*. The guide pin 81*f* moves along the arc-shaped longitudinal guide slot portion 53*b* so that the guide pin 81*f* moves along a path generally centered at the boss portion 82*a* which is the rotational center of the key lever 82. That is, the center of curvature of the arc-shaped longitudinal guide slot portion 53*b* generally coincides with the boss portion 82*a*. The engagement portion 81*e* of the open link 81 is positioned in the longitudinal guide slot portion 53*a* and extends outside the housing 5. The guide pin 81*f* which is positioned in and guided by the longitudinal guide slot portion 53*b* is formed on the upper end of the open link 81.

With the forgoing construction, the engaged pin portion 81*d* is engageable with the engagement arm portion 82*c* of the key lever 82. In addition, the engagement pin portion 81*e* is engageable with the flange wall 83*b* of the inside lever 83 while the engagement pin portion 81*e* is positioned in the longitudinal guide slot portion 53*a*. Thus, the open link 81 is linked to the key lever 82 and the inside lever 83 (i.e., the non-set condition of the lever mechanism 8). The engagement pin portion 81*e* of the open link 81 is engaged with the flange wall 83*b* of the inside lever 83 by the counterclockwise rotation of the inside lever 83. Otherwise, the open link 81 is moved in the upward direction of FIG. 2, guided by the longitudinal guide slot portion 53*a*, the pin 81*a* moving in the longitudinal guide slot 81*b* and the longitudinal guide slot portion 53*b*, by engagement of the engagement arm portion 82*c* and the engagement pin portion 81*d* as a result of rotation of the key lever 82 in the clockwise direction of FIG. 2. The engagement portion 81*c* is engageable with the second engagement portion 41*b* of the lift lever 4. Thus, the open link 81 is linked to the lift lever 4. The lift lever 4 is rotated in the counterclockwise direction of FIG. 5 by the engagement of the engagement portion 81*c* and the second engagement portion 41*b* due to the movement of the open link 81 in the upward direction of FIG. 2 to disengage the pawl 32 from the latch 31.

A spring 86 is provided between the housing 5 and the open link 81. Upward movement of the open link 81 as seen with reference to FIG. 2 compresses the spring 86. The open link 81 is returned to the initial position shown in FIG. 2 by the biasing force of the spring 86.

The cover 53 includes a longitudinal guide slot (groove) portion 53*d* continuing from the bottom of the longitudinal guide slot portion 53*a* and having a different shape or orientation from that of the longitudinal guide slot portion 53*a*. The cover 53 also includes a longitudinal guide slot (groove) portion 53*c* continuing from the bottom end of the longitudinal guide slot portion 53*b* and having a different shape or orientation from that of the longitudinal guide slot portion 53*b*. Stated differently, the longitudinal guide slot portion 53*d* is offset from or oriented generally transverse to the longitudinal guide slot portion 53*a* while the longitudinal guide slot portion 53*c* is offset from or oriented generally transverse to the longitudinal guide slot portion 53*b*.

The engagement pin portion 81*e* of the open link 81 is positioned in the longitudinal guide slot portion 53*d* and the guide pin 81*f* is positioned in the longitudinal guide slot portion 53*c*. As shown in FIG. 3, the guide slot portions 53*b*, 53*c* are smoothly connected to one another. The smooth transition between the guide slot portions 53*b*, 53*c* allow the engagement pin portion 81*e* to smoothly move from one of the guide slot portions to the other. Thus, the open link 81 is adapted to rotate about a rotation axis generally at the pin 81*a* by moving the engagement pin portion 81*e* into the longitudinal guide slot portion 53*d* and moving the guide pin 81*f* into the longitudinal guide slot portion 53*c*. That is, the generally smoothly connected guide slot portions 53*b*, 53*c* cause the guide pin 81*f* to move in a way resulting in rotation of the open link 81 so that the engagement pin portion 81*e* is able to move past the otherwise sharp corner between the guide slot portions 53*a*, 53*d*. Of course, the relatively sharp corner between the guide slot portions 53*a*, 53*d* can be made smoother than that illustrated in FIG. 3.

With the foregoing construction, by rotating the open link 81 about the pin 81*a* in the clockwise direction of FIG. 2 with the engagement pin portion 81*e* moving along the longitudinal bore 53*d* and the guide pin 81*f* moving along the longitudinal groove 53*c*, the engagement pin portion 81*e* is disengaged from the flange wall 83*b* of the inside lever 81 (i.e., the set condition of the lever mechanism 8). Stated differently, the engagement pin portion 81*e* is moved to a position located outside the path of movement (movement path locus) of the flange wall 83*b* of the inside lever 81. The rotation of the open link 81 is performed by the actuation of the electric motor 71 or another electric driving power source different from the electric motor 71.

Although the described and illustrated embodiment operates by rotating the open link 81 about the pin 81*a*, it is to be understood that the pin 81*a* is not necessary to achieve such rotation. That is, the rotation of the open link 81 can be achieved by virtue of the configuration of the guide slot portions 53*b*, 53*c*, and possibly also the guide slot portions 53*a*, 53*d*. The guide slot portions 53*a*, 53*d* and the guide slot portions 53*b*, 53*d* form guide grooves or guide slots that guide the movement of the engagement pin portion 81*e* and the guide pin 81*f*.

The guide slot portions 53*b*, 53*c* in conjunction with the guide pin 81*f* define a guiding mechanism for guiding movement of the open link 81 in the direction for effecting unlatching of the latch mechanism (unlatching movement of the open link 81) and in the rotational direction to achieve the set condition of the lever mechanism 8.

Figure 6:
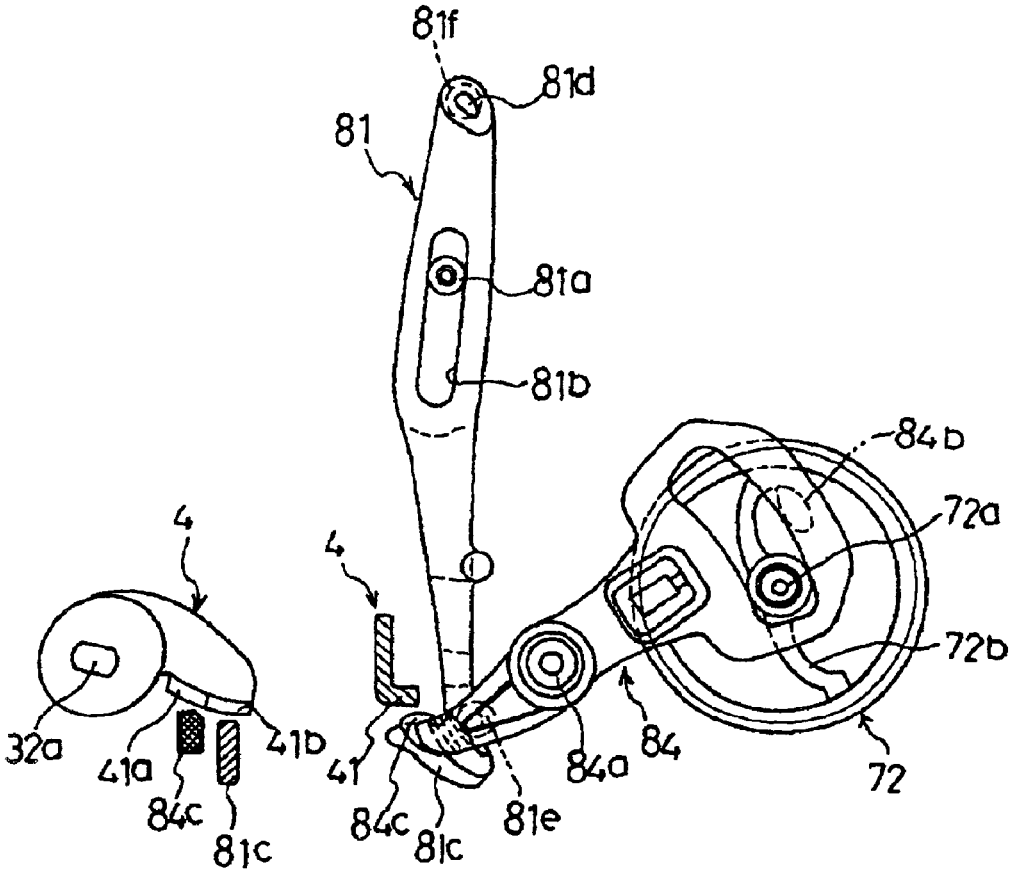
FIG. 6 is a front view showing an initial condition of a lever mechanism for the door latch operation device.
Figure 7:
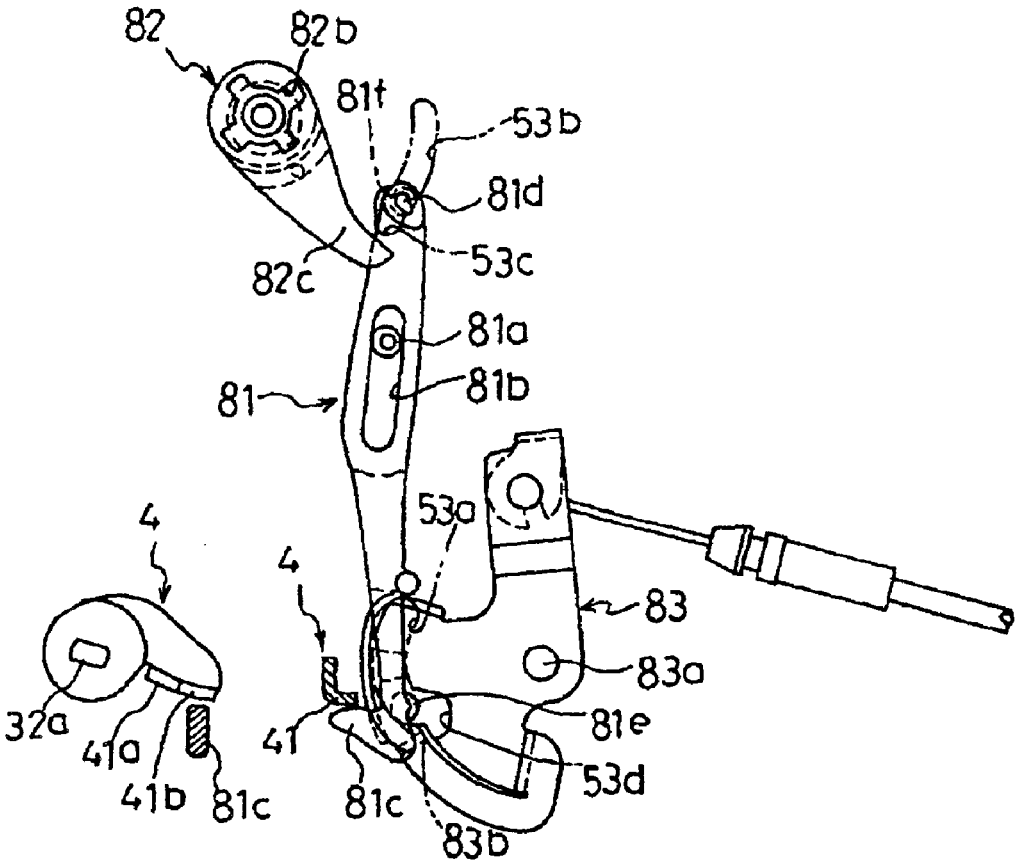
FIG. 7 is a front view showing an initial condition of the lever mechanism for the door latch operation device.

The operation of the vehicle door latch operation device is as follows. FIGS. 6 and 7 show the open lever 84 and the open link 81 at their respective initial positions and the lever mechanism 8 at the non-set condition, in which the flange wall 83*b* of the inside lever 83 and the engagement pin portion 81*e* of the open link 81 are engageably positioned opposite to each other. As shown in FIG. 5, the latch mechanism 3 is at the latched condition in which the vehicle door 1 is maintained at the closed condition relative to the vehicle body 11.

Figure 8:
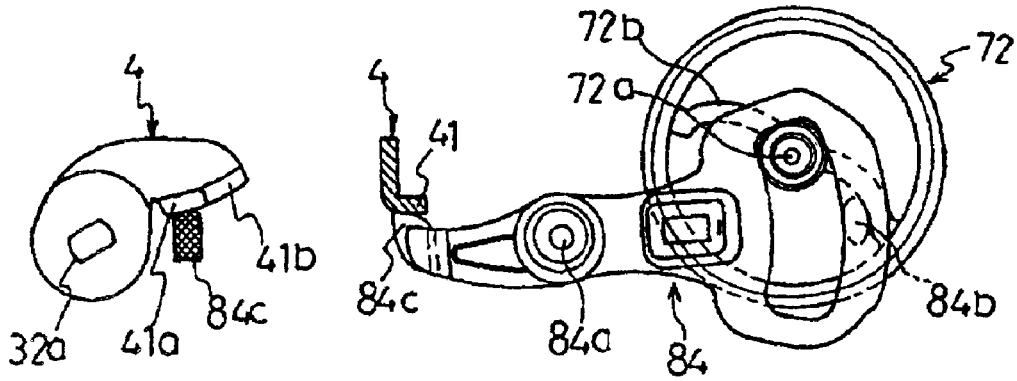
FIG. 8 is a front view showing an operation condition of the lever mechanism for the door latch operation device.

Under the non-set condition, by actuating the electric motor 71 through operation of either one of the opening switches 12*a*, 13*a* when the vehicle door 1 is determined to be in the unlock condition by the CPU of the controller 9, the wheel gear 72 is rotated in the clockwise direction of FIG. 6 to rotate the open lever 84 in the clockwise direction of FIG. 6 by the engagement between the engagement projection portion 72*b* and the engagement projection 84*b*. Thus, as shown FIG. 8, the engagement portion 84*c* is engaged with the engagement portion 41*a* to rotate the lift lever 4 in the counterclockwise direction of FIG. 8. Accordingly, the pawl 32 is rotated in the counterclockwise direction of FIG. 5 for disengaging the latch 31 from the pawl 32. The latch mechanism 3 is thus under the unlatched condition and the vehicle door 1 can be opened. When the vehicle door 1 is determined to be in the locked condition by the CPU of the controller 9, the electric motor 71 is not actuated irrespective of whether the opening switches 12*a*, 13*a* are operated. Thus, the latch mechanism 3 is not moved to the unlatched condition.

Figure 9:
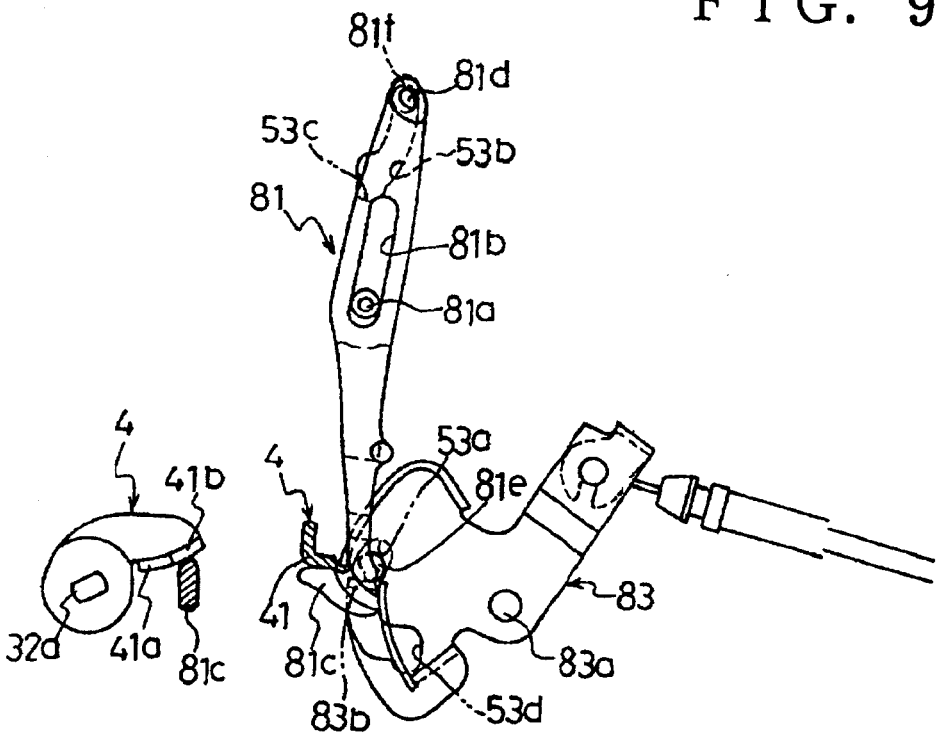
FIG. 9 is a front view showing the operation condition of the lever mechanism for the door latch operation device.

When the inside lever 83 is rotated in the clockwise direction of FIG. 7 by operating the inside handle 15, the engagement pin portion 81*e* and the flange wall 83*b* are engaged to move the open link 81 in the upward direction of FIG. 7 while moving the engagement pin 81*e* in the longitudinal guide slot 53*a* and moving the guide pin 81*f* in the longitudinal groove 53*b*. Thus, as shown in FIG. 9, the engagement portion 81*c* is engaged with the engagement portion 41*b* for rotating the link lever 4 in the counterclockwise direction of FIG. 9. The pawl 32 is rotated in the counterclockwise direction of FIG. 5 for disengaging the pawl 32 from the latch 31 so that the latch mechanism 3 is in the unlatched condition, thus allowing the vehicle door 1 to be opened. Accordingly, the latch mechanism 3 can be positioned in the unlatched condition irrespective of the whether the vehicle door is determined to be either in the lock condition or the unlock condition by the CPU of the controller 9. Thus, even when the electric motor 71 is not operated due to a failure of, for example, the controller 9 or when the condition of the vehicle door 1 cannot be determined to be the unlock condition from the lock condition, the vehicle door 1 can be opened to prevent the possibility that the occupants will be confined in the vehicle compartment. Security for the occupants is thus ensured.

Figure 10:
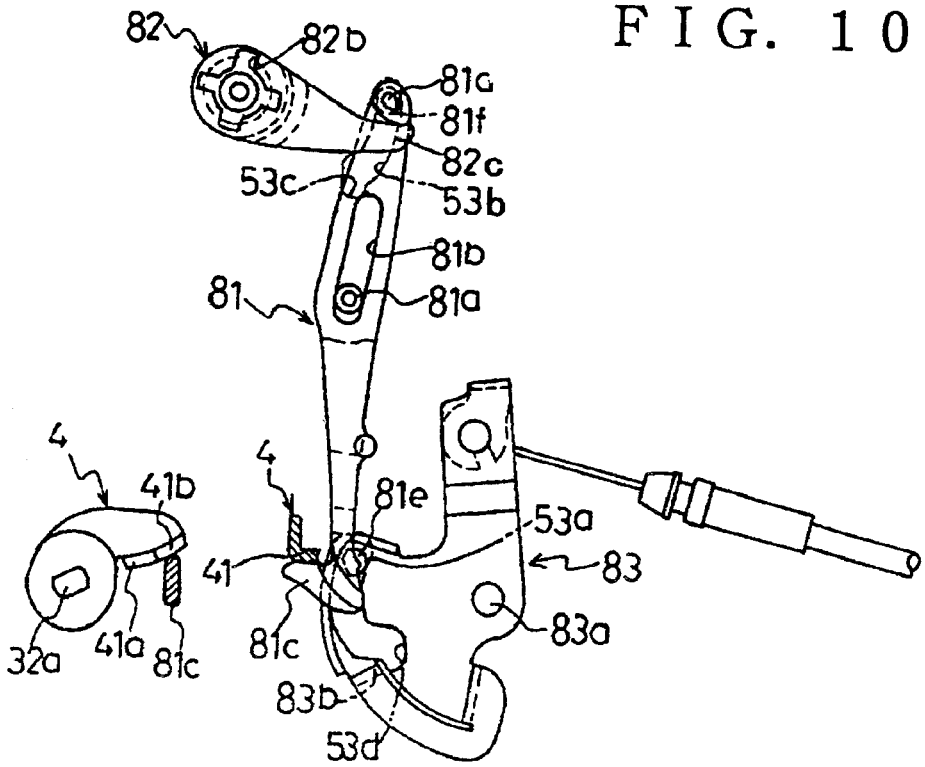
FIG. 10 is a front view showing the operation condition of the lever mechanism for the door latch operation device.

By rotating the key lever 82 in the counterclockwise direction of FIG. 7 by the operation of the key cylinder 14, the engagement arm portion 82*c* and the engagement pin portion 81*d* are engaged so that the open link 81 is moved in the upward direction in FIG. 7 while moving the engagement pin portion 81*e* in the longitudinal guide slot 53*a* and moving the guide pin 8 if in the longitudinal groove 53*b*. Thus, as shown in FIG. 10, the engagement portion 81*c* is engaged with the engagement portion 41*b* for rotating the lift lever 4 in the counterclockwise direction of FIG. 10. The pawl 32 is thus rotated in the counterclockwise direction of FIG. 5 to be disengaged from the latch 31. The latch mechanism 3 is thus in the unlatched condition to set the vehicle door 1 in a condition to be opened. Accordingly, the latch mechanism 3 can be positioned in the unlatched condition irrespective of whether the vehicle door 1 is determined to be in either the lock condition or the unlock condition by the CPU of the controller 9. Even when the electric motor 71 is not operated due, for example, a failure of the controller 9 and when the unlock condition of the vehicle door 1 is not able to be set, the vehicle door 1 can be opened.

Figure 11:
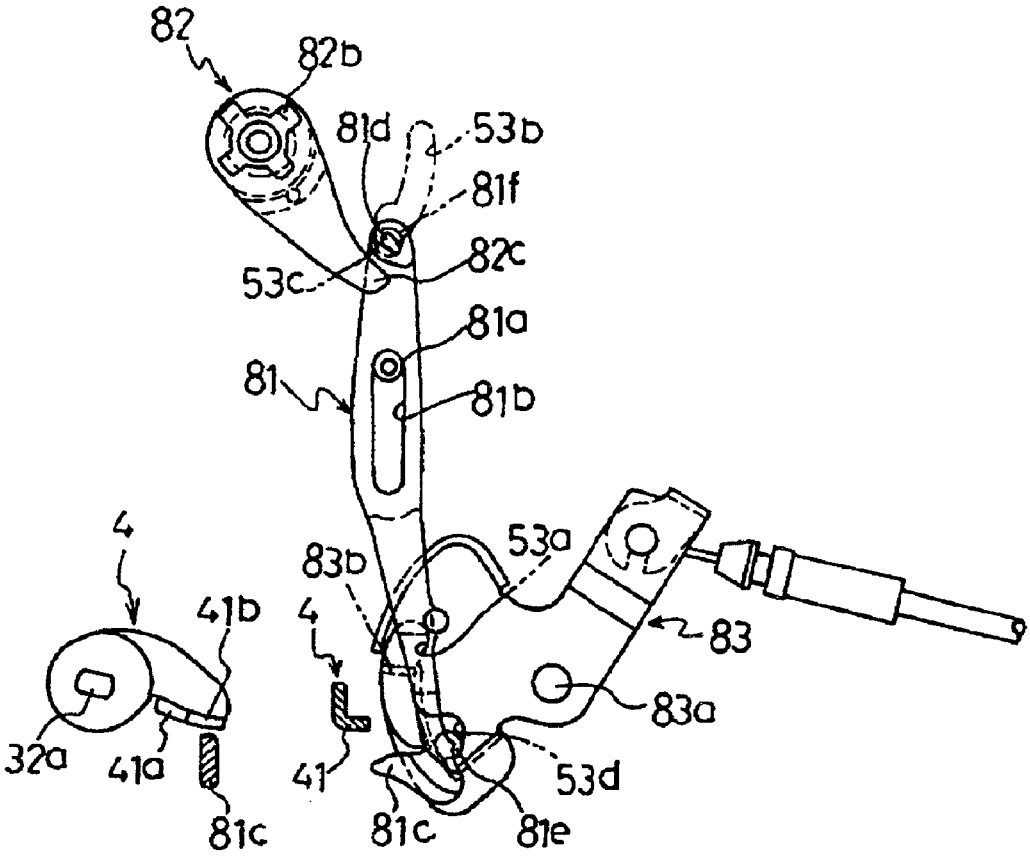
FIG. 11 is a front view showing the operation condition of the lever mechanism for the door latch operation device.
Figure 12:
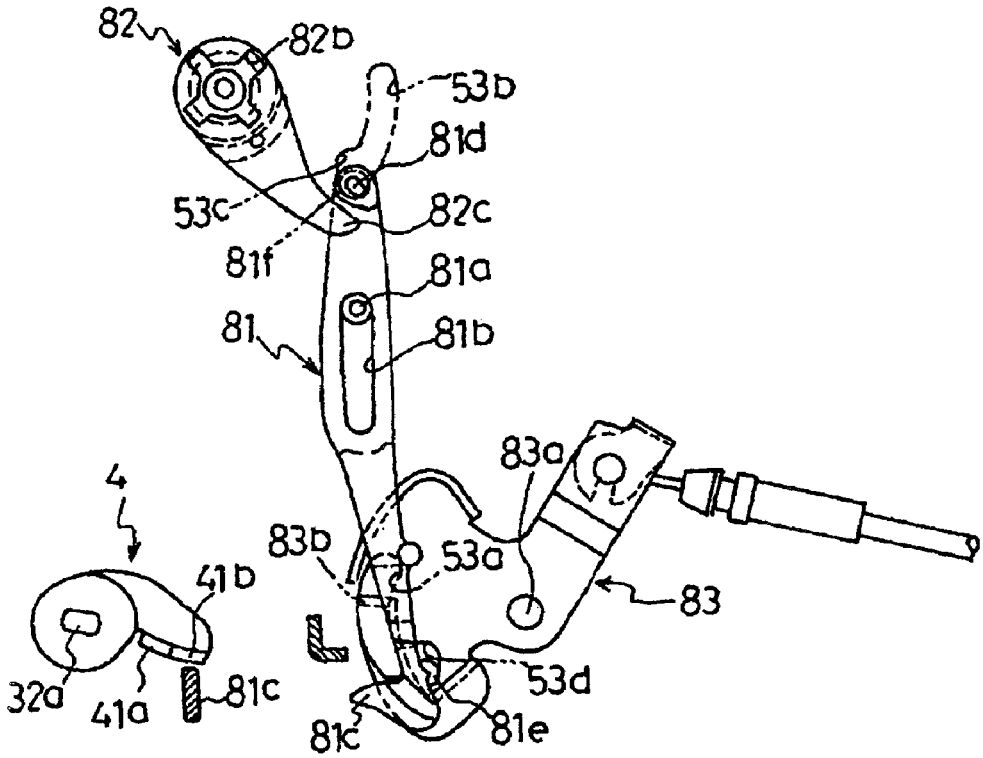
FIG. 12 is a front view showing the operation condition of the lever mechanism for the door latch operation device.

When the open link 81 is rotated in the counterclockwise direction of FIG. 7 by the actuation of the driver power source such as the electric motor 71 as shown in FIG. 11, the set condition is determined in which the engagement pin 81*e* is disengaged from the flange wall 83*b* by moving in the longitudinal bore 53*d* and the guide pin 81*f* moves in the longitudinal groove 53*c*. Under the set condition, when the inside lever 83 is rotated by operating the inside handle 15 as shown in FIG. 12, the open link 81 is not moved upward because the flange wall 83*b* does not engage the engagement pin portion 81*e*. Thus, in this case, the latch mechanism 3 is not moved to the unlatched condition by the operation of the inside handle 15. When the lever mechanism 8 is under the set condition, the latch mechanism 3 is not moved to the unlatched condition even if the inside handle 15 is operated.

Figure 13:
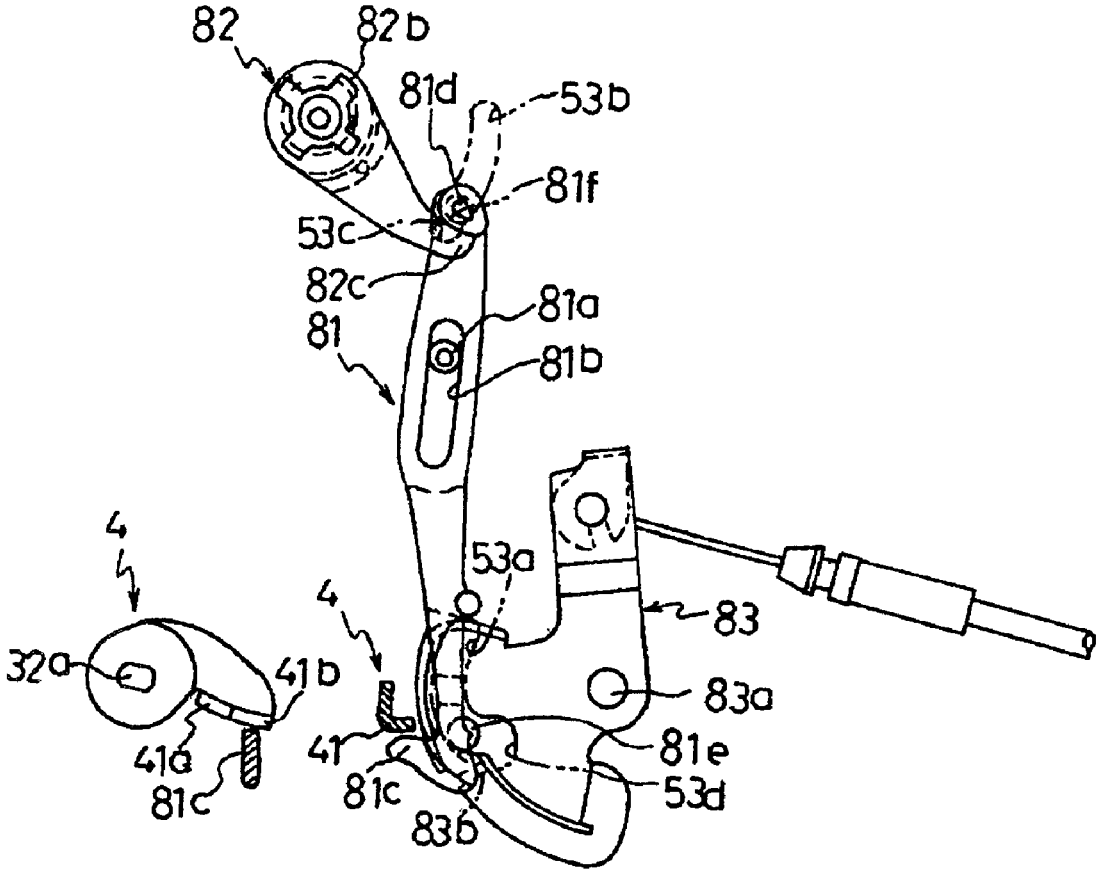
FIG. 13 is a front view showing the operation condition of the lever mechanism for the door latch operation device.

When the key cylinder 14 is operated for rotating the key lever 82 in the counterclockwise direction of FIG. 11 under the set condition of the lever mechanism 8, the open link 81 is moved upward of FIG. 11 by the engagement of the engagement arm portion 82*c* and the engagement pin portion 81*d*. Thus, the engagement portion 81*c* and the engagement portion 41*b* are engaged for rotating the link lever 4 in the counterclockwise direction of FIG. 11. Accordingly, the pawl 32 is rotated in the counterclockwise direction of FIG. 5 to disengage the pawl 32 from the latch 31, with the latch mechanism 3 thus being moved to the unlatched condition to set the vehicle door 1 to be opened. In this case, the open link 81 as shown FIG. 13 is rotated in the clockwise direction of FIG. 13 by the movement of the guide pin 81*f* into the longitudinal guide slot 53*b* while being guided by the wall of the longitudinal groove 53*c*. The open link 81 is thus returned to the non-set condition shown in FIG. 7. The biasing force of the spring 86 assists the rotation of the open lever 81 returning to the initial position for reducing the operation force. Thus, even when the lever mechanism 8 is under the set condition, the latch mechanism 3 is moved to the unlatched condition by operating the key cylinder 14. irrespective of whether the vehicle door 1 is under the lock condition or the unlock condition, and the lever mechanism 8 is at the non-set condition. Accordingly, even when the driving power source is not actuated due to an abnormality such as a failure of the power source (e.g., the electric motor 71) for operating the lever mechanism 8 to be at the set condition or the non-set condition, the latch mechanism 3 is changed to the unlatched condition while changing the lever mechanism 8 from the set condition to the non-set condition through operation of the key cylinder 14. Thus, the vehicle door 1 can be opened to avoid the possibility of the occupants being unable to exit the vehicle compartment and thus ensuring the security of the occupants. Because the key cylinder 14 is operated by the key such as the ignition key carried by an individual, it is difficult to be operated by others who do not have the key and so the anti-theft performance is improved or ensured.

According to the above-described embodiment of the vehicle door latch operation device, the open link which is linked to the mechanical identification member and is linked to the mechanical operation member via the inside lever is movable to be engaged with the lift lever and is rotatable to be engaged with and disengaged from the inside lever. The open link is rotated by the operation of the mechanical identification member via the guiding mechanism. Thus, when the mechanical operation member and the latch mechanism are linked, the vehicle door is securely opened by the operation of the mechanical identification member. Accordingly, the security for individuals or occupants can be ensured.

The open link is rotated while moving via the functioning of the guiding mechanism when operating the mechanical identification operation member. Thus, the inside lever and the open link are returned from the linkage release condition to the linked condition by the rotation of the open link while actuating the latch mechanism by the movement of the open link. Accordingly, the mechanical operation member and the latch mechanism can be linked by the operation of the mechanical identification operation member.

As described above, the vehicle door latch operation device is provided with an open link which is linked to the mechanical operation member and the mechanical identification operation member, and is also provided with the open lever which is linked to the electric actuation mechanism. The actuation of the latch mechanism by the operation of the mechanical operation member and the mechanical identification operation member is performed via the connecting portion between the open link and the latch mechanism. The actuation of the latch mechanism by the actuation of the electric operation mechanism is performed via the connecting portion between the open lever and the latch mechanism. Thus, the number of connecting portions of the latch mechanism to the respective levers can be reduced. Accordingly, the size of the latch mechanism can be reduced and the installation of the door latch operation device to the vehicle becomes easier.

According to the illustrated and described embodiment of the vehicle door latch operation device, the lift lever on which is provided the engagement portion for engagement with the open link and the engagement portion for engagement with the open lever is adapted to unitarily rotate with the pawl. Thus, the size of the pawl can be reduced and the pawl is prevented from unexpectedly rotating by receiving inertia. The safety of the vehicle is thus improved. In addition, because the connecting portion of the lift lever with the open lever is positioned between the rotation center and the connecting portion of the lift lever with the open link, the operation force required for the operation of the mechanical operation member and the mechanical identification operation member is reduced.

In addition, the inside lever for engaging with and disengaging from the open link is provided between the mechanical operation member and the open link, and the linkage between the open link and the mechanical operation member is released by the inside lever for preventing actuation of the latch mechanism by undesired operation of the inside lever. The anti-theft performance is thus improved.

Further, the latch mechanism is supported by the housing, and the open link and the open lever are accommodated in the housing along with the electric actuation mechanism. The anti-theft performance is thus improved while reducing the size of the device as a whole without using other parts such as a protector.

The principles, preferred embodiment and modes of operation of the present invention have been described in the foregoing specification. However, the invention which is intended to be protected in not to be construed as limited to the particular embodiment disclosed. Further, the embodiment described herein is to be regarded as illustrative rather than restrictive. Variations and changes may be made by others, and equivalents employed, without departing form the spirit of the present invention. Accordingly, it is expressly intended that all such variations, changes and equivalents which fall within the apart and scope of the present invention as defined in he claims, be embraced thereby.

What is claimed is:

1. A vehicle door latch operation device comprising:

a latch mechanism provided on a vehicle door that is adapted to be opened and closed relative to a vehicle body for effecting a latched condition in which the vehicle door is maintained at a closed condition relative to the vehicle body and an unlatched condition in which the vehicle door is adapted to be opened relative to the vehicle body;

a mechanical operation member provided in an interior compartment of the vehicle for operating the latch mechanism from the latched condition to the unlatched condition;

a mechanical identification operation member provided outside the vehicle for operating the latch mechanism from the latched condition to the unlatched condition;

a lift lever operatively connected to the latch mechanism;

an inside lever operatively connected to the mechanical operation member;

an open link provided between the lift lever and the inside lever, the open link being adapted to be operatively connected to the mechanical operation member and the mechanical identification operation member to move the open link and cause the open link to engage the lift lever, the open link also being rotatable to permit selective engagement of the open link with the inside lever to effect a locked state and an unlocked state;

a rotatable key lever operatively connected to the mechanical identification operation member and engageable with the open link, with movement of the key lever causing operation of the lift lever only by way of the open link;

the inside lever moving the lift lever, without rotating the key lever, upon operation of the mechanical operation member in the unlocked state to operate the latch mechanism; and a guiding mechanism for movably and rotatably guiding the open link.

2. The vehicle door latch operation device according to claim 1, further comprising:

a support member movably and rotatably supporting the open link, the open link having a first end portion and a second end portion;

the guiding mechanism comprising a guiding portion and a guide pin, the guide portion being formed on the support member for allowing movement and rotation of the open link, the guide pin being provided at the first end portion of the open link and positioned in the guiding portion to be guided along the guiding portion; and the open link being operatively connected to the mechanical identification operation member at the first end portion, and being engageable with and disengageable from the inside lever at the second end portion, the guide pin being guided by the guiding portion in response to operation of the mechanical identification operation member for moving and rotating the open link.

3. The vehicle door latch operation device according to claim 1, further comprising:

an electric actuation mechanism which operates the latch mechanism from the latched condition to the unlatched condition; and an open lever linked to the electric actuation mechanism and engageable with the lift lever.

4. The vehicle door latch operation device according to claim 3, wherein the latch mechanism comprises a rotatable latch adapted to be engaged with and disengaged from a striker provided on the vehicle body, and a rotatable pawl engageable with the latch to effect the latched condition of the latch mechanism and disengageable from the latch to effect the unlatched condition of the latch mechanism;

the lift lever being unitarily rotated with the pawl and engageable with the open link and the open lever; and a first engagement portion at which the lift lever engages the open lever and a second engagement portion at which the lift lever engages the open link, the first engagement portion being positioned between the second engagement portion and a rotational center of the open link.

5. The vehicle door latch operation device according to claim 4, wherein the inside lever is provided between the mechanical operation member and the open link, and is engageable with and disengageable from the open link.

6. The vehicle door latch operation device according to claim 3, further comprising:

a housing having a support portion supporting the latch mechanism, and an accommodating portion positioned at a substantially right angle relative to the support portion and accommodating the electric actuation mechanism, the open link, and the open lever.

7. The vehicle door latch operation device according to claim 6, wherein the mechanical identification operation member is supported by the housing.

8. A vehicle door latch operation device comprising:

a latch mechanism provided on a vehicle door that is adapted to be opened and closed relative to a vehicle body for effecting a latched condition in which the vehicle door is maintained at a closed condition relative to the vehicle body and an unlatched condition in which the vehicle door is adapted to be opened relative to the vehicle body;

an electric actuation mechanism which operates the latch mechanism from the latched condition to the unlatched condition;

a mechanical operation member provided in an interior compartment of the vehicle for operating the latch mechanism from the latched condition to the unlatched condition;

a mechanical identification operation member provided outside the vehicle for operating the latch mechanism from the latched condition to the unlatched condition;

a lift lever operatively connected to the latch mechanism;

a lever mechanism comprising:

an inside lever operatively connected to the mechanical operation member;

an open link provided between the lift lever and the inside lever, the open link being adapted to be operatively connected to the mechanical operation member and the mechanical identification operation member to move the open link and cause the open link to engage the lift lever, the open link also being rotatable to permit selective engagement of the open link with the inside lever to effect a locked state and an unlocked state;

an open lever linked to the electric actuation mechanism and engageable with the lift lever to move the lift lever upon actuation of the electric actuation mechanism in both the locked state and the unlocked state to operate the latch mechanism; and a key lever operatively connected to the mechanical identification operation member and engageable with the open link, with movement of the key lever causing operation of the lift lever only by way of the open link;

a base member on which the open link is movably and rotatably supported;

a guiding mechanism for movably and rotatably guiding the open link.

9. The vehicle door latch operation device according to claim 8, wherein the key lever includes an engagement arm portion and the open link includes an engagement pin which is engageable by the engagement arm portion.

10. The vehicle door latch operation device according to claim 8, wherein the guiding mechanism comprises a guiding portion formed on the base member for allowing movement and rotation of the open link, and a guide pin provided at a first end portion of the open link and positioned in the guiding portion to be guided along the guiding portion; and the open link being operatively connected to the mechanical identification operation member at the first end portion, and being engageable with and disengageable from the inside lever at a second end portion of the open link, the guide pin being guided by the guiding portion in response to operation of the mechanical identification operation member for moving and rotating the open link.

11. The vehicle door latch operation device according to claim 9, wherein the mechanical identification operation member is operated with an ignition key.

12. The vehicle door latch operation device according to claim 11, wherein, when the inside lever is disengaged from the open link, the latch mechanism is unable to be switched to the unlatched condition from the latched condition upon operation of the mechanical operation member.

13. The vehicle door latch operation device according to claim 8, wherein the latch mechanism comprises a rotatable latch adapted to be engaged with and disengaged from a striker provided on the vehicle body, and a rotatable pawl engageable with the latch to effect the latched condition of the latch mechanism and disengageable from the latch to effect the unlatched condition of the latch mechanism;

the lift lever being unitarily rotated with the pawl and engageable with the open link and the open lever; and a first engagement portion at which the lift lever engages the open lever and a second engagement portion at which the lift lever engages the open link, the first engagement portion being positioned between the second engagement portion and a rotational center of the open link.

14. The vehicle door latch operation device according to claim 8, wherein the inside lever is provided between the mechanical operation member and the open link, and is engageable with and disengageable from the open link.

15. The vehicle door latch operation device according to claim 8, further comprising a housing having a support portion supporting the latch mechanism, and an accommodating portion positioned at a right angle to the support portion and accommodating the electric actuation mechanism, the open link, and the open lever.

16. The vehicle door latch operation device according to claim 15, wherein the mechanical identification operation member is supported by the housing.

17. A vehicle door latch operation device comprising:

a latch mechanism provided on a vehicle door that is adapted to be opened and closed relative to a vehicle body for effecting a latched condition in which the vehicle door is maintained at a closed condition relative to the vehicle body and an unlatched condition in which the vehicle door is adapted to be opened relative to the vehicle body;

an inside door handle provided in an interior of the vehicle;

a lift lever operatively connected to the latch mechanism;

an inside lever operatively connected to the inside door handle;

a key cylinder provided on an outside of the vehicle;

a key lever operatively connected to the key cylinder;

an open link between the inside lever and the lift lever, the open link being supported at a housing for unlatching movement to engage the lift lever and effect the unlatched condition of the latch mechanism and being supported at the housing for rotatable movement to permit selective engagement of the open link with the inside lever to effect a locked state and an unlocked state, the inside lever and the key lever being operatively engageable with the open link;

a guiding pin provided on one of the open link and the housing and a guiding slot provided on the other of the open link and the housing, the guiding pin being positioned in the guiding slot, the guiding slot being configured to guide the open link in the unlatching movement and the rotatable movement;

the inside lever moving the lift lever, without rotating the key lever, upon operation of the mechanical operation member in the unlocked state to operate the latch mechanism;

the open link being rotatable between a first position in which operation of the inside door handle and the key lever causes the unlatching movement of the open link to effect the unlatched condition of the latch mechanism and a second position in which the unlatching movement of the open link is prevented when the inside door handle is operated;

an electric actuation mechanism which operates the latch mechanism from the latched condition to the unlatched condition; and an open lever linked to the electric actuation mechanism and engageable with the lift lever.

18. The vehicle door latch operation device according to claim 17, wherein the key lever is engageable with the open link in the second position of the open link to cause the unlatching movement of the open link so that the open link engages the lift lever to effect the unlatched condition of the latch mechanism.

19. The vehicle door latch operation device according to claim 17, wherein the guiding slot includes two guiding slot portions which are offset with respect to one another.

20. The vehicle door latch operation device according to claim 1, wherein the operation of the mechanical identification operation member causes operation of the latch mechanism from the latched condition to the unlatched condition without operating the mechanical operation member.

21. The vehicle door latch operation device according to claim 1, wherein the operation of the mechanical identification operation member causes operation of the latch mechanism from the latched condition to the unlatched condition even when the vehicle door is in a locked condition.

22. The vehicle door latch operation device according to claim 8, wherein the operation of the mechanical identification operation member causes operation of the latch mechanism from the latched condition to the unlatched condition without operating the mechanical operation member.

23. The vehicle door latch operation device according to claim 8, wherein the operation of the mechanical identification operation member causes operation of the latch mechanism from the latched condition to the unlatched condition even when the vehicle door is in a locked condition.

24. The vehicle door latch operation device according to claim 17, wherein the operation of the key cylinder causes unlatching movement of the open link to effect the unlatched condition of the latch mechanism without operating the inside door handle.

25. The vehicle door latch operation device according to claim 8, wherein the operation of the key cylinder causes unlatching movement of the open link to effect the unlatched condition of the latch mechanism even when the vehicle door is in a locked condition.

26. The vehicle door latch operation device according to claim 1, wherein the open link is rotatably guided by the guiding mechanism to rotate from a first position in which the inside lever moved in response to operation of the mechanical operation member causes the open link to engage the lift lever and effect the unlatched condition of the latch mechanism to a second position in which the inside lever moved in response to operation of the mechanical operation member does not engage the open link.

27. The vehicle door latch operation device according to claim 8, wherein the inside lever is rotatably mounted at a first pin and the open lever is rotatably mounted at a second pin different from the first pin.

28. The vehicle door latch operation device according to claim 8, wherein the electric actuation mechanism is operable independent of operation of the mechanical operation member.

29. The vehicle door latch operation device according to claim 17, wherein movement of the key lever causes operation of the lift lever only by way of the open link.

* * * * *